US006035944A

United States Patent [19]

Neuner et al.

[11] Patent Number: 6,035,944

[45] Date of Patent: Mar. 14, 2000

[54] HINGED PLOW ATTACHMENT FOR WHEELED AND TRACKED VEHICLES

[75] Inventors: Thomas Joseph Neuner, Dunbar; Robert E. Plumley, Iron Mountain, both of Mich.

[73] Assignee: M. J. Electric, Inc., Iron Mountain, Mich.

[21] Appl. No.: 09/085,058

[22] Filed: May 27, 1998

[51] Int. Cl.[7] ..... E02F 3/76

[52] U.S. Cl. ..... 172/818; 37/468; 414/723

[58] Field of Search ..... 172/818, 805, 172/821–826; 414/697, 723, 685, 689, 722, 724, 725, 732, 912; 37/403, 468, 271, 272, 218, 217, 903, 274, 283

[56] References Cited

U.S. PATENT DOCUMENTS

| | | |
|---|---|---|
| 3,157,099 | 11/1964 | Ulrich . |
| 3,231,117 | 1/1966 | Melroe et al. . |
| 3,378,084 | 4/1968 | Ulrich . |
| 3,512,283 | 5/1970 | Moody et al. . |
| 3,539,022 | 11/1970 | Berg . |
| 3,672,521 | 6/1972 | Bauer et al. . |
| 4,328,628 | 5/1982 | Thomas . |
| 4,512,090 | 4/1985 | Billings . |
| 4,540,330 | 9/1985 | Taylor . |
| 4,658,519 | 4/1987 | Quenzi . |
| 4,718,814 | 1/1988 | Addleman . |
| 4,906,161 | 3/1990 | Weyer . |
| 4,999,022 | 3/1991 | Veys . |
| 5,087,168 | 2/1992 | McKinnon et al. . |
| 5,114,299 | 5/1992 | Roche et al. . |
| 5,165,191 | 11/1992 | Davis . |
| 5,281,076 | 1/1994 | Lehman . |
| 5,403,144 | 4/1995 | Staben, Jr. . |
| 5,562,398 | 10/1996 | Knutson . |

*Primary Examiner*—Thomas B. Will
*Assistant Examiner*—Robert Pezzuto
*Attorney, Agent, or Firm*—Jim Zegeer

[57] ABSTRACT

A plow blade mounting system for mounting an adjustable V-plow blade on any wheeled or tracked vehicle having a vertical lift mechanism including arms extending forwardly of the vehicle. A rear mounting plate assembly has a first swivel plate adapted for attachment to the vertical lift mechanism and a pivot member secured to the first swivel plate. A second swivel plate is pivotally mounted on a pivot member, and a T-frame assembly is securely mounted on the second swivel plate and has a forwardly projecting end and a triangularly shaped plate member secured to the second swivel plate and the T-frame. A hydraulic actuator extends between the first and second swivel plates for effecting relative rotating movement of the first swivel plate relative to the second swivel plate about the pivot member. A plurality of slots are formed in one of the swivel plates and a corresponding plurality of swivel plate retention pins project through the slots and secured to the other of the swivel plates retains the swivel plates in assembly. A vertical blade pivot and plate secured to the forward end of the T-frame assembly and a pair of blade members having inner ends pivotally connected to the vertical pivot, respectively, are actuated by hydraulic actuators about the vertical blade pivot.

3 Claims, 8 Drawing Sheets

HINGED PLOW ATTACHMENT FOR WHEELED AND TRACKED VEHICLES

BACKGROUND AND BRIEF DESCRIPTION OF THE INVENTION

Front loader work vehicles are useful in performing earth working such as grading, earth moving, digging, etc. Typically, the work vehicle incorporates a pair of forwardly projecting loader arms to which a scoop or bucket work implement is pivotally connected. A pair of hydraulic actuators actuate the projecting loader arms in vertical directions and a further hydraulic actuator controls the fore and aft pitch pivoting of the work implement. In addition to scoop or bucket work implements, dozer blades, fork lifts, sweepers, etc., have been mounted on the pair of forwardly projecting loader arms. In such work implements, the load is transferred to the two forwardly projecting arms from two laterally spaced points. In the case of a V-plow wherein a pair of plow blades are mounted on a single vertical hinge or pivot, and each blade is actuated by an hydraulic actuation, the load is transferred from the center of the mount to the loader arms.

The present invention provides an adjustable mount for adjustable V-plow blades which efficiently couples and transfers loads from a single centrally located vertical blade hinge or pivot to the spaced loader arms and at the same time provides for rotary adjustment of the hinge about a longitudinal axis which is perpendicular to the axis of the vertical hinge or pivot.

According to the invention, a rear mounting plate assembly, which includes a first swivel plate, coupled to the pair of forwardly projecting loader arms and the fore and aft pitch hydraulic actuator. A T-frame assembly includes a second swivel plate pivotally mounted on a pivot pin mounted in the first swivel plate in the rear mounting plate assembly. A T-frame cross beam and T-frame center tube are welded to a triangularly shaped plate member, with the base of the triangularly shaped member and cross beam welded to the swivel plate to provide a high-strength, load-transferring structure for substantially evenly distributing the load from the central vertical hinge or pivot to the rear mounting plate assembly and thence to the loader arms. The rear mounting assembly includes the first swivel plate which is stationary relative to the loader arms. A plurality of retention pins secured to the first swivel plate and project through a corresponding plurality of arcuate slots on the second swivel plate and retain the two swivel plates in parallel assembly during operation and relative rotation between the rear mounting plate assembly and the T-frame assembly. A double-acting hydraulic actuator is connected between the rear mounting plate assembly and the T-frame assembly to effect rotation of the T-frame assembly relative to the rear mounting plate assembly.

In addition to the triangular shaped plate member welded to the cross beam and T-frame center tube, for the dirt or earth working plow embodiment, a pair of triangular gusset plates are welded at their bases to the vertical hinge in a plane orthogonal to the plane of the triangular plate welded to the cross beam and center tubes, with the end of the T-frame center tube below the approximate center of the vertical hinge. The second swivel plate is strengthened by a pair of brace plates which are welded to the second swivel plate and the upper surface of the triangularly shaped plate member which is welded to the T-frame center and cross beam tubes. One of the pair of brace plates has an overhang which serves as a mounting plate for an hydraulic fluid manifold.

In the snow plow embodiment of the invention, the vertical blade hinge is part of a cowling structure which is pivotally mounted on the end of the T-frame center tube. The pair of triangular gusset plates are not required and a set of springs coupled to the cowling and the T-frame structure provide for full blade trip when the snow plow blades encounter or get snagged on a road surface obstruction; this allows the blades to pivot and pass the obstruction and be returned to normal plowing position by the spring assembly in the manner disclosed in Quenzi U.S. Pat. No. 4,658,519. In this embodiment, the hydraulic actuators for the blades have one end coupled to the cowling structure.

Thus the invention relates to a plow attachment mechanism for skid steer or front loader type work vehicles; and, more particularly, this invention relates to a mounting assembly for V-blade type plows in which at least a pair of blades are hingedly connected on a vertically extending hinge and in which, in addition to the up-and-down and tilt movements of a conventional skid steer utility bucket, the present invention provides for rotation of the blade mounting assembly and blades about an axis running longitudinally of the mounting mechanism of the blades and for movement of the blades to V and scoop positions as well as a straight blade or at all angles desired for plowing. Thus, the invention provides an 8-way blade movement for skid steer type vehicles.

An hydraulic manifold, which is mounted on the brace plate overhang, receives pressurized hydraulic fluid from a supply and solenoid-operated valves control the flow of hydraulic fluid to and from the hydraulic cylinders for the tilt mechanism and for operating the plow blade to any orientation desired. The normal loader arm and pitch control hydraulic system of the front loader are not affected by the invention.

Thus, the plow blades are movable about a vertical axis to V-shape and for plowing and to an inverted V-configuration for a scoop operation. The invention is useful for both snow plowing and for dirt plowing.

BRIEF DESCRIPTION OF THE DRAWINGS

The above and other objects, advantages and features of the invention will become more clear when considered with the following specification and accompanying drawings wherein.

DETAILED DESCRIPTION OF THE INVENTION

Figure 1:
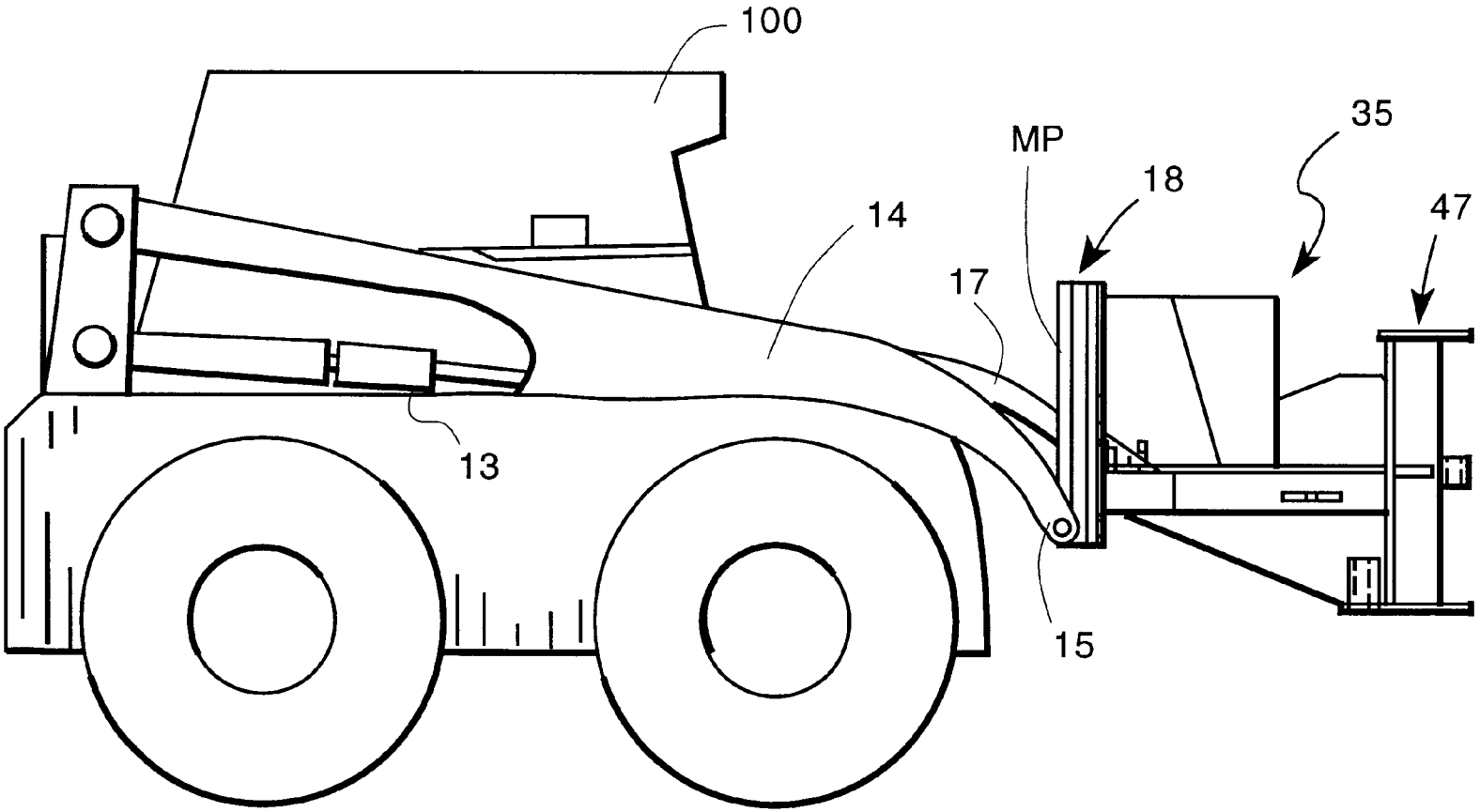
FIG. 1 is a side elevational view of a skid steer loader-type vehicle incorporating the invention.

Referring to FIG. 1, a skid steer loader-type work vehicle 10 has a pair of forwardly projecting parallel loader arms which are spaced a distance apart and are pivoted at the rear 11 of the vehicle and actuated about pivot 12 by hydraulic cylinders 13 controlled from a control in a cab 14 of work vehicle 10. The forward end of loader arms 11 include a horizontal pivot 15 on which is mounted an attachment tool carrier plate MP. Typically, a loader bucket (not shown) is mounted on tool carrier plate MP and pitch of tool carrier plate MP (any work implement mounted thereon) is controlled by an hydraulic actuator 17.

Figure 10:
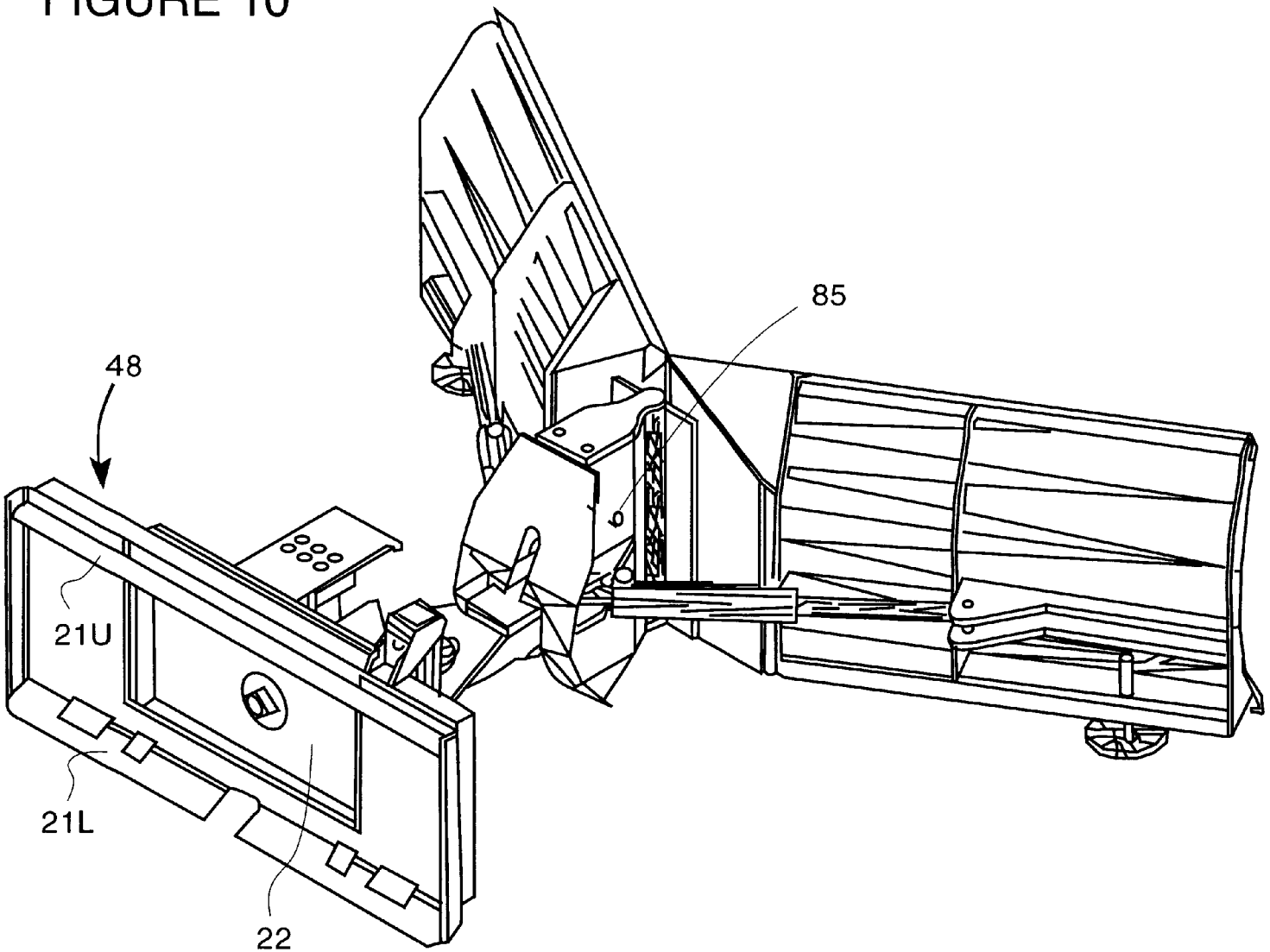
FIG. 10 is a rear isometric view of the second embodiment of the invention as applied to V-snow plow blades with full blade trips.
Figure 11:
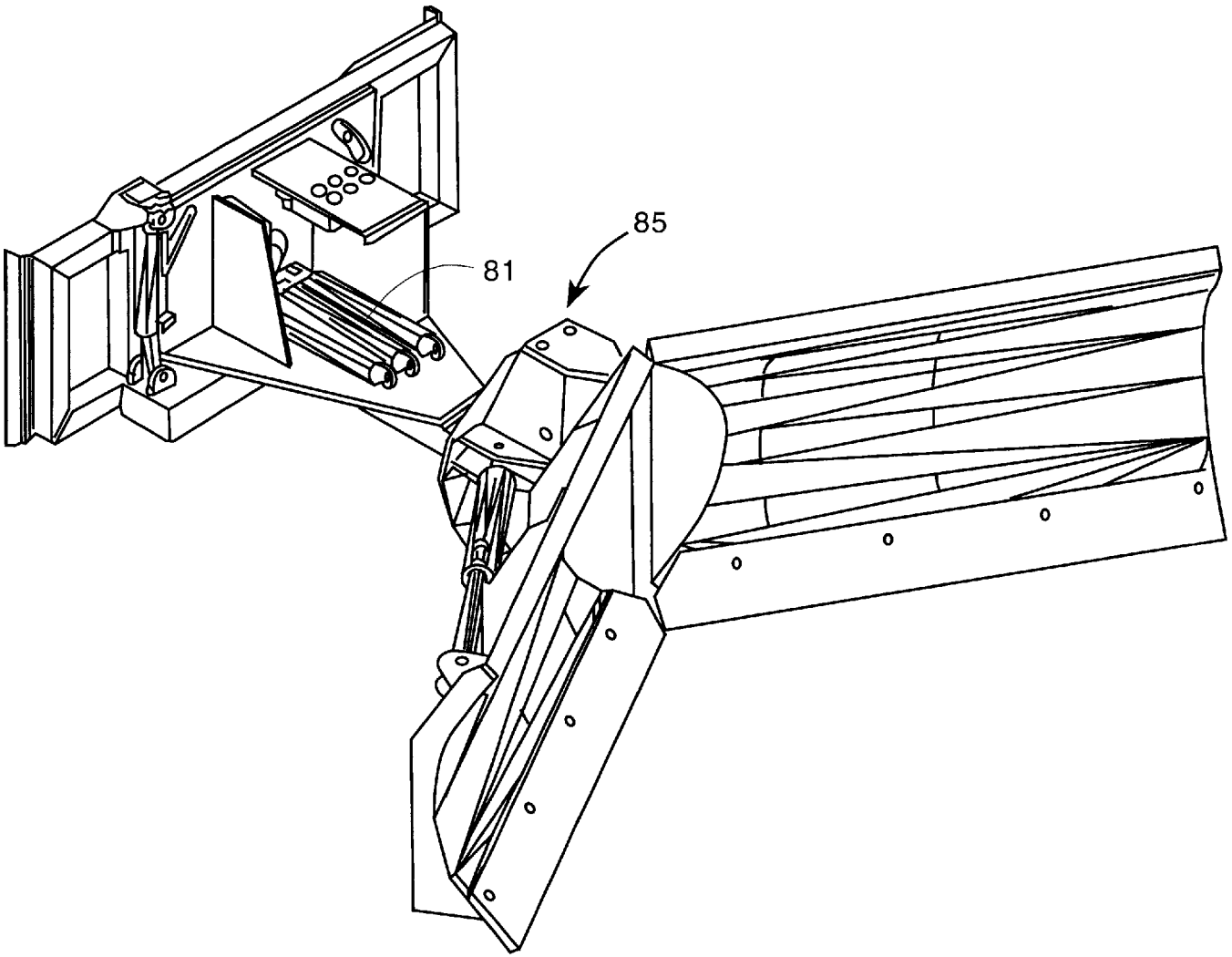
FIG. 11 is a front elevational view of the snow plow embodiment of the invention.

The present invention replaces the normal bucket with a mounting assembly for a pair of adjustable blades which may be used for plowing dirt (see the embodiment shown in FIGS. 2–9) or for plowing snow (see the embodiment shown in FIGS. 10 and 11).

Figure 2:
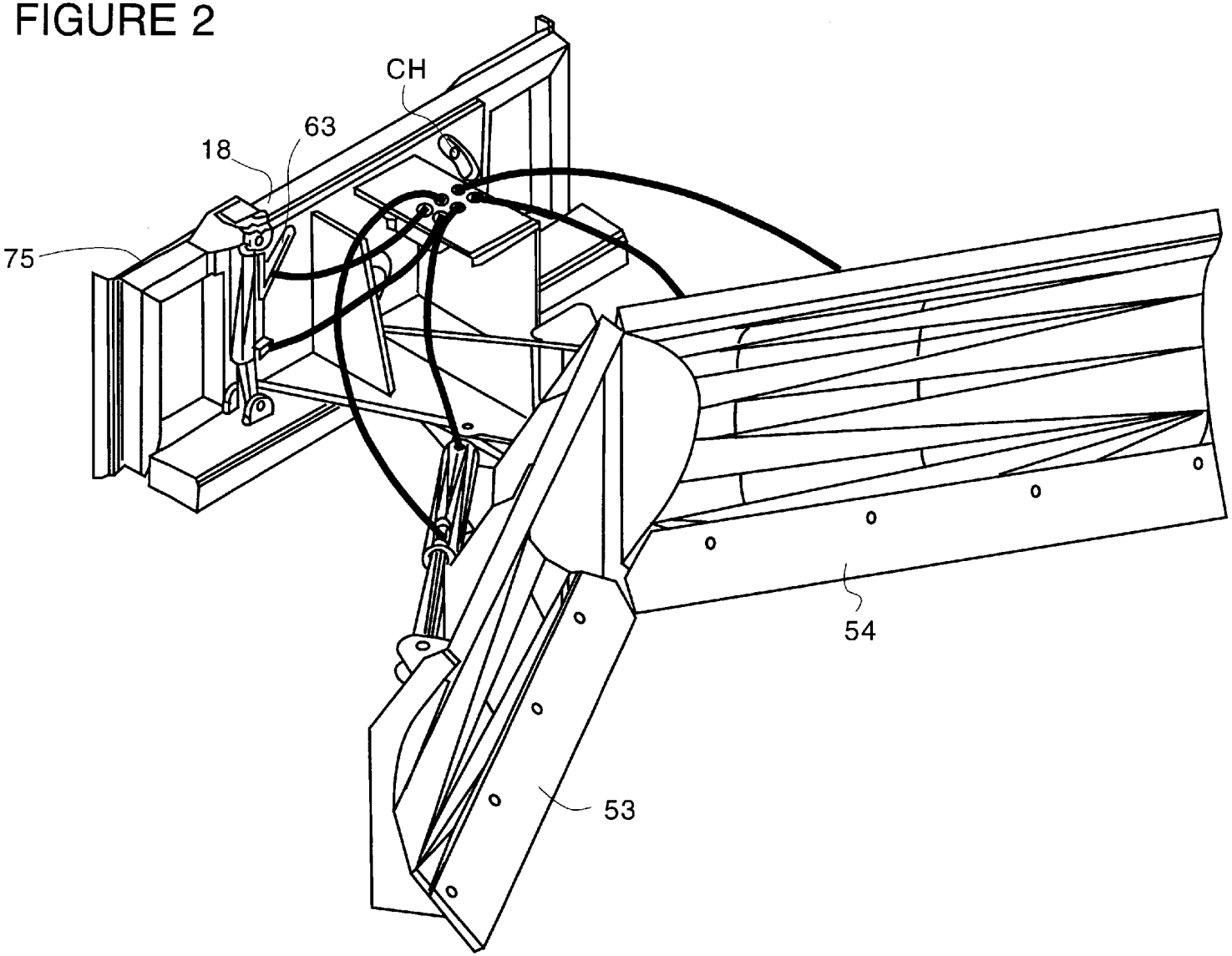
FIG. 2 is a front isometric view of a dirt V-plow attachment incorporating the invention.
Figure 3:
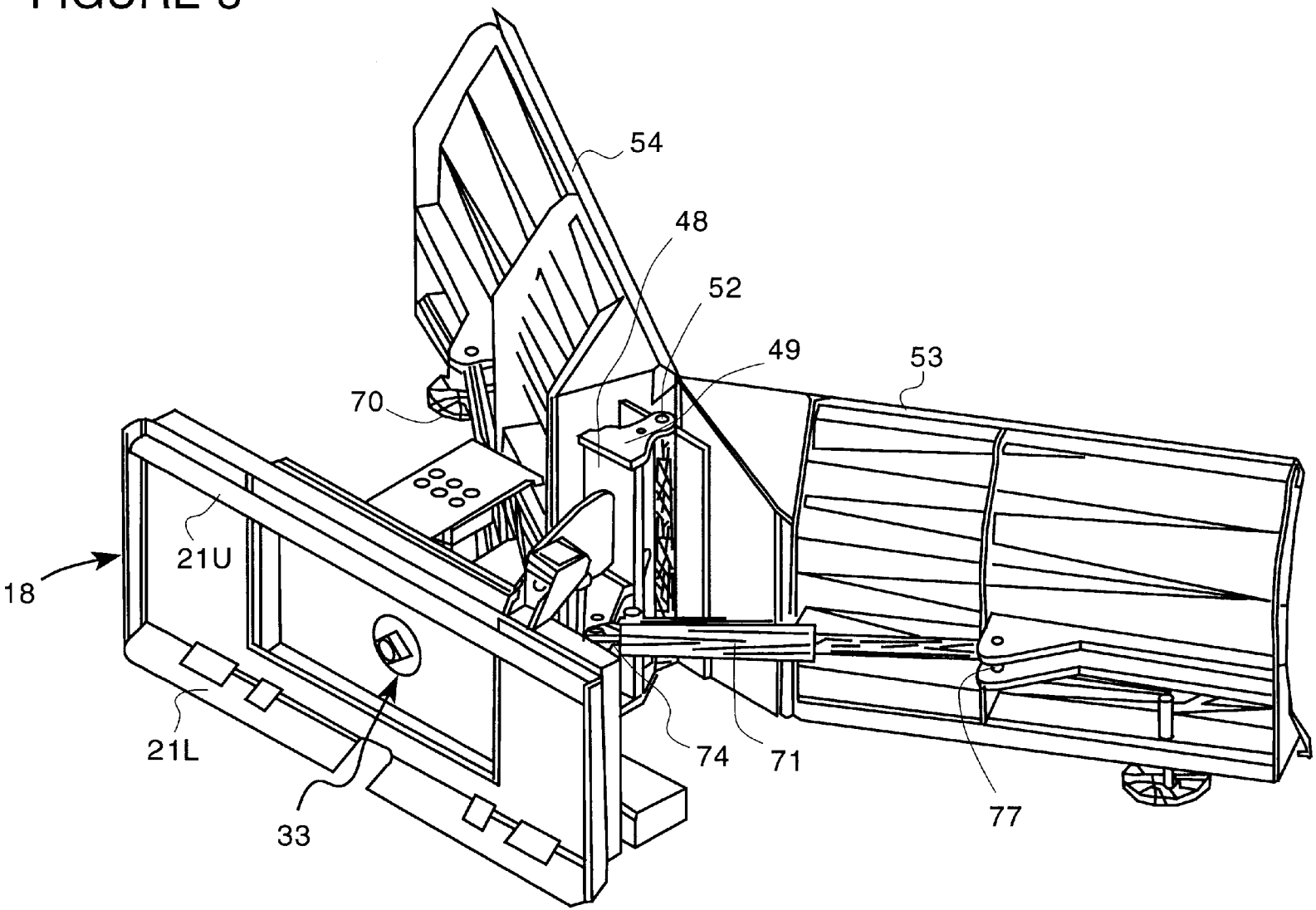
FIG. 3 is an isometric view from the rear of a adjustable V-plow attachment incorporating the invention.
Figure 4:
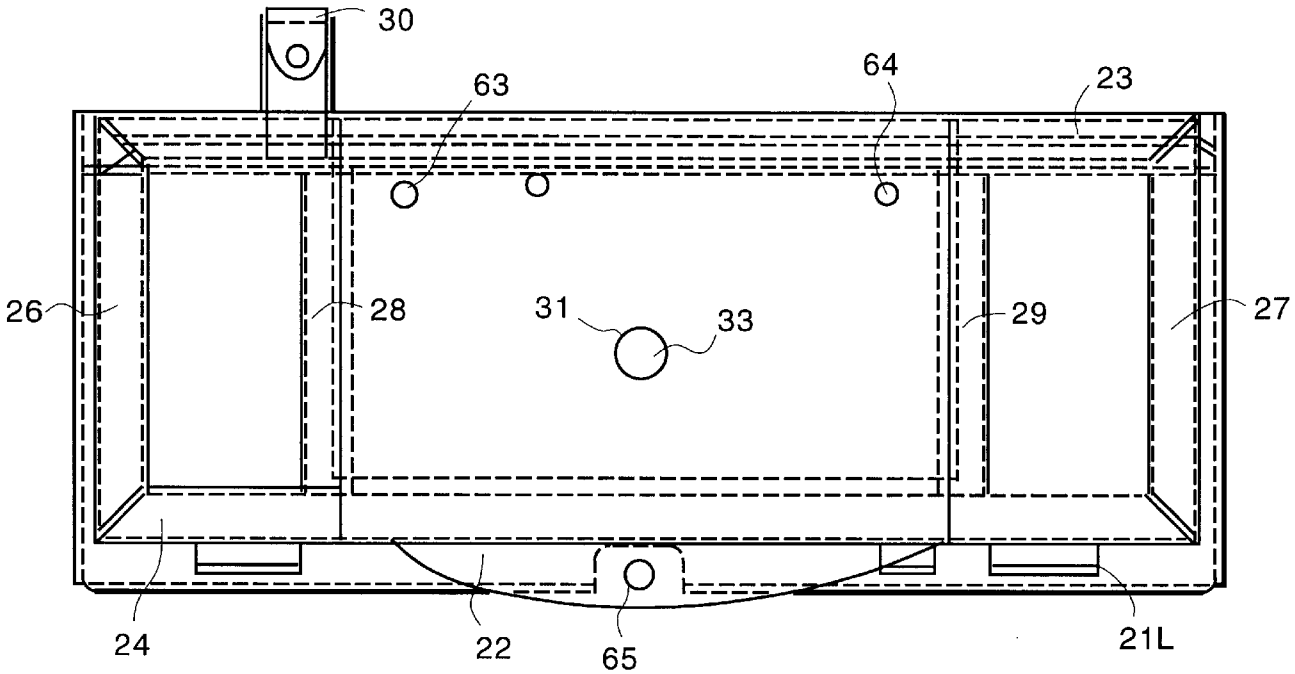
FIG. 4 is a front plan view of a rear mounting plate.
Figure 5:
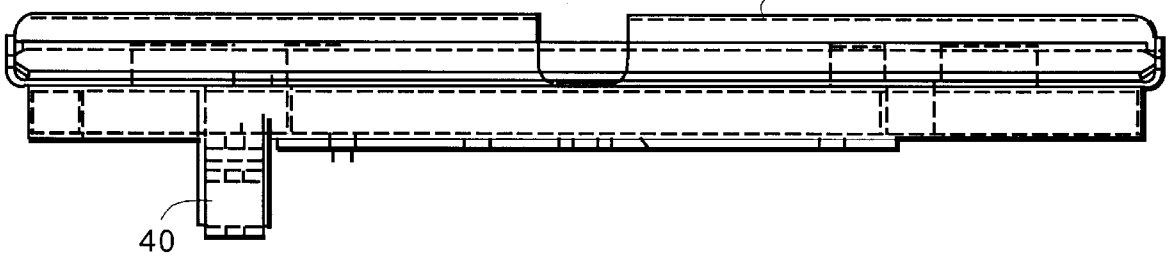
FIG. 5 is a top plan view of the rear mounting plate.
Figure 7:
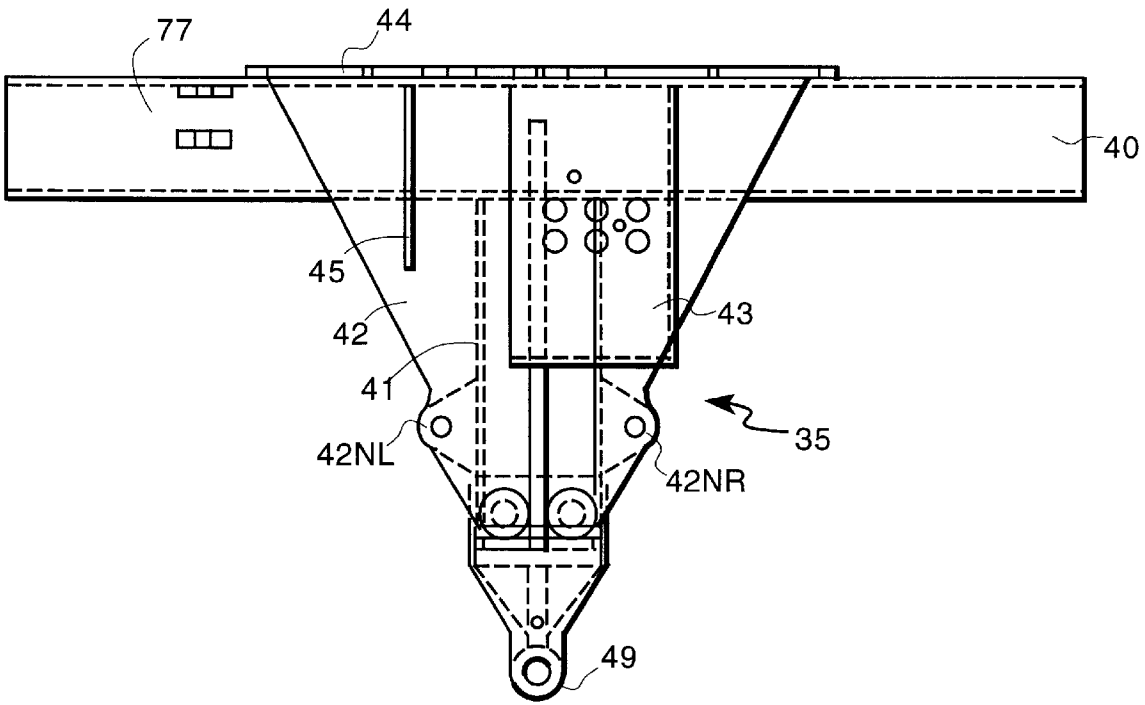
FIG. 7 is a top plan view of the front mounting swivel plate and the T-frame assembly incorporated in the invention.
Figure 6:
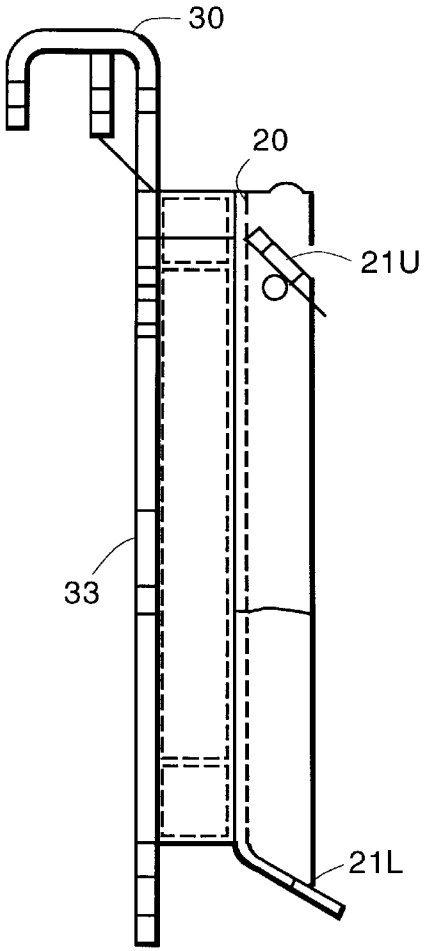
FIG. 6 is a side elevational view of the rear mounting plate.
Figure 8:
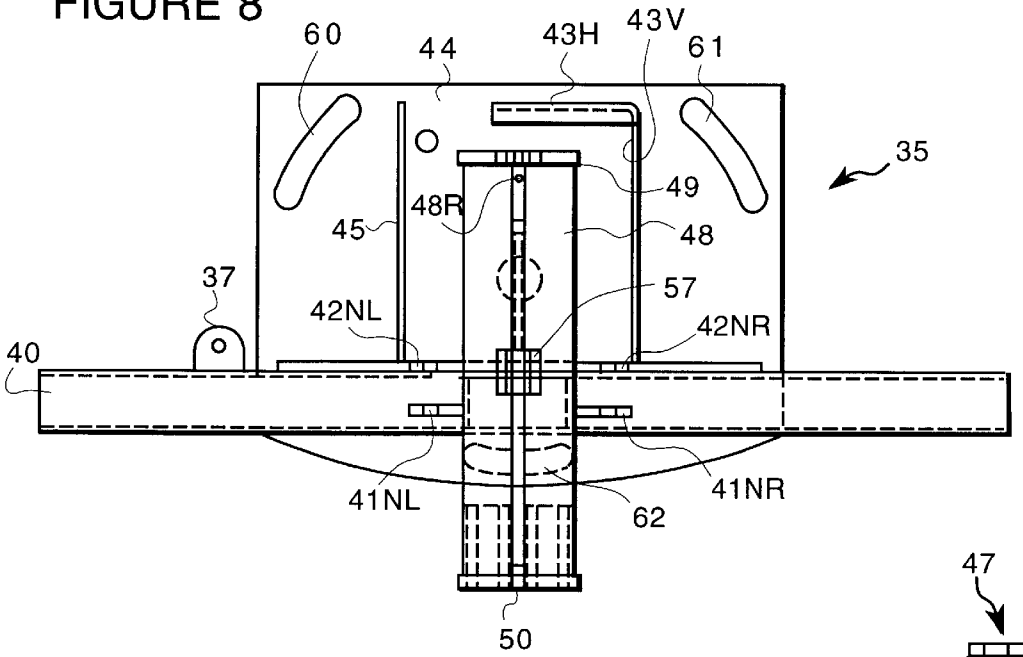
FIG. 8 is a front elevational view of the T-frame and swivel plate assembly.
Figure 9:
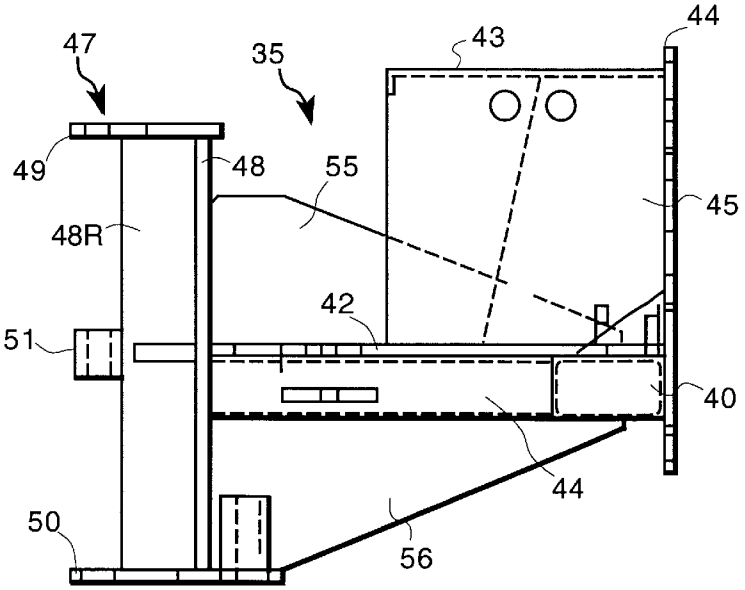
FIG. 9 is a side elevational view of the T-frame and swivel mounting plate.

Referring to FIGS. 2–9, the preferred dirt plow embodiment of the invention incorporates a rear mounting plate assembly 18 (FIGS. 4, 5 and 6). The rear mount plate assembly includes a mount adaptor plate 20, mount frame backbars 21 and 216 which are secured to attachment tool carrier plate MP in the usual fashion, and a mount swivel plate 22. Mount frame top and bottom tubings 23, 24 and mount frame end tubings 26, 27 along with mount frame inner tubing 28, 29 are all welded in assembly. In addition, a power tilt upper cylinder mount 30 is welded in assembly. Swivel plate 22 includes a central aperture 31 for mounting a pivot pin 33 (FIG. 3). A plurality of retention pins 63, 64, 65 with retention heads 66, 67 and 68 are mounted on swivel plate 22.

A T-frame adaptor assembly 35 (shown in detail in FIGS. 7–9) incorporates a T-frame cross-tube 40, a T-frame center tube 41, a horizontal deck plate 42 which is generally triangularly shaped, and a gusset plate and manifold cover 43. Gusset and manifold cover 43 has a vertical portion 43V which is welded to swivel plate 44 and horizontal deck plate 42 and a horizontal portion 43H which is welded to swivel plate 44 and forms a support for hydraulic manifold 80. A second swivel plate 44 is welded to gusset cover member 43 and T-frame cross-tube 40 with T-frame center tube welded in the center of T-frame cross-tube 40. For strength purposes, a gusset or bracing plate 45 is welded between the horizontal deck plate 42 and swivel plate 44. The blade's hinge assembly 47 includes a vertical plate member 48V welded to the end of T-frame center tube 41. A rigidifying plate 48R is welded in the center of the front surface of vertical plate member 48V. Upper 49 and lower 50 hinge pin bushings along with center bushing 51 receive a hinge pin for mounting the adjustable blades 53, 54. It should be noted that for this dirt plow embodiment, hinge plate 48 is braced by triangularly shaped gusset members 55, 56 with gusset member 55 being welded along its length to the horizontal deck plate 42 which in turn has been welded to the T-frame center tube 41 and the lower gusset plate 56 is welded to the hinge plate 48 and along its length to the lower surface of T-frame center tube 41. This provides an extremely rugged assembly for efficiently distributing the loads to the ends of the loader arm.

The T-frame adaptor assembly 35 is mounted via swivel plate 44 on a central pivot pin 33 which passes through rear swivel plate 22 and T-frame adaptor assembly swivel plate 44. Three slots 60, 61 and 62 are formed in swivel plate 44. Three stationary swivel plate retention pins 63, 64 and 65 are mounted in rear swivel plate 22 and project forwardly through slots 60, 61 and 62 and retention members 66, 67 and 68 on the ends of pins 63, 64 and 65 preclude separation between the two swivel plates 22 and 44. In this embodiment, dirt blades 53, 54 are hingedly mounted on hinge pin assembly 47 which includes hinge pin 52. Hydraulic actuators 70, 71 are mounted between points 73 on the blade 53 and the T-frame adaptor assembly 35 (see FIGS. 7, 8 and 9). An actuator mounting nub 42NL and 42NR on dirt trap plate 42 and lugs 41NL and 41NR on the left and right sides of T-frame assembly 35 receive the ends of actuators 70 and 71 and transfer load to the T-frame assembly 35.

An hydraulically tilt cylinder actuator 75 is mounted between power tilt cylinder mount 77 on the T-frame assembly and the power cylinder mount assembly 30 on the front adaptor plate assembly. The full piston extension tilt cylinder actuator 75 and the full piston retraction lengths are just sufficient to prevent the swivel plate retention pins 63, 64, 65 from hitting the ends of slots 60, 61 and 62, respectively.

An hydraulic manifold assembly 80 is mounted on manifold cover plate 43 and supplies hydraulic fluid to the piston cylinders 70, 71 and 75 which are double acting hydraulic cylinders, and each are coupled to the hydraulic manifold 80 by hydraulic hoses HH as indicated. Solenoid operated valves (not shown), which are conventional, are connected to a control box CB located at the operator's position in cab 14.

The dirt plow embodiment shown in FIGS. 1–9 is preferred for dozing, grading, trenching and backfilling the dirt and is adapted to fit all skid steers, front end load vehicles, and farm tractors with tool carriers. It provides independent or simultaneous blade positioning with easy-to-use operator controls. The plow blades or wings can be adjusted to a V-shape, scoop-shape, straight or at any angle in-between.

The embodiment shown in FIGS. 10 and 11 incorporate essentially the same physical construction as disclosed in FIGS. 2 and 3, except, in this embodiment, the plow blades are mounted in the fashion disclosed in Quenzi U.S. Pat. No. 4,658,579. In this embodiment, the central hinge for the blades is mounted in a cowling frame assembly pivotally mounted on the forward end of the T-frame central tube. In this case, a horizontal pivot for cowling subassembly 85 is on the forward end of the T-frame and the hydraulic actuators for the positioning of the blades about the central vertical hinge have their respective inner ends coupled to the cowling subassembly 85. Gusset plates 55 and 56 are eliminated and a spring assembly 81 is coupled in the manner disclosed in the Quenzi patent which is incorporated herein by reference. Thus, when used as a snow plow adaptor, when plowing snow for example, and an immovable obstruction in the road such as a curb or a bump in the road is encountered, the blade tilts forwardly and stretches the springs 81 until the obstruction is passed and then the springs return the blade to the normal plowing position. This action alleviates some of the loading transferred to the loader arms via the T-frame adaptor assembly.

While preferred embodiments of the invention have been described and illustrated, it will be appreciated that various embodiments, adaptations, modifications and changes to the invention can be made by those skilled in the art.

What is claimed is:

1. In a plow blade mounting system for mounting a plow blade on a work vehicle having a vertical lift mechanism including arms extending forwardly of said vehicle, the improvement comprising:

a rear mounting plate assembly including a first swivel plate adapted for attachment to said vertical lift mechanism, a pivot member secured to said first swivel plate, a second swivel plate pivotally mounted on said pivot member, a T-frame assembly securely mounted on said second swivel plate and having a forwardly projecting end and a triangularly shaped plate member welded to said second swivel plate and said forwardly projecting end, a hydraulic actuator cylinder extending between said rear mounting plate assembly and T-frame assembly for effecting relative rotating movement of said first swivel plate relative to said second swivel plate about said pivot member, a plurality of slots formed in one of said swivel plates and a corresponding plurality of swivel plate retention pins projecting through said slots and secured to the other of said swivel plates, a vertical blade pivot and plate secured to the forward end of said T-frame assembly and a pair of blade members having inner ends pivotally connected to said vertical blade pivot, respectively, hydraulic actuator means for moving said blade members about said vertical blade pivot, and a solenoid operated hydraulic manifold controlling the flow of hydraulic fluid to said hydraulic cylinder and said hydraulic actuator means to rotate said blades about said vertical pivot and said plate about said horizontal pivot.

2. The invention defined in claim 1 including a pair of gusset plates welded to the top and bottom of said T-frame assembly and said plate of said vertical blade pivot and plates.

3. The invention defined in claim 1 in which said vertical blade pivot and plate are mounted on a horizontal pivot in the forward end of said T-frame assembly and a spring means extends between said vertical blade pivot and said T-frame assembly.

* * * * *